United States Patent [19]

Grimes

[11] 3,938,680

[45] Feb. 17, 1976

[54] BUCKET ATTACHMENT

[76] Inventor: Homer L. Grimes, Rural Rte. No. 1, Hepler, Kans. 66746

[22] Filed: Aug. 19, 1974

[21] Appl. No.: 498,393

[52] U.S. Cl. ..... 214/145 R; 37/118 R

[51] Int. Cl.[2] ..... E02F 3/40

[58] Field of Search ..... 214/145, 77 R, 131 A; 37/117.5, 118

[56] References Cited

UNITED STATES PATENTS

| | | | |
|---|---|---|---|
| 2,584,163 | 2/1952 | Squires | 214/77 R |
| 3,097,439 | 7/1963 | Calkin | 37/117.5 |
| 3,478,449 | 11/1969 | Baker | 37/117.5 |
| 3,598,266 | 8/1971 | Fisher | 214/145 |

FOREIGN PATENTS OR APPLICATIONS

| | | | |
|---|---|---|---|
| 1,121,146 | 7/1968 | United Kingdom | 214/131 A |

*Primary Examiner*—Robert J. Spar
*Assistant Examiner*—Ross Weaver
*Attorney, Agent, or Firm*—Lowe, Kokjer, Kircher

[57] ABSTRACT

An attachment for installation on the bucket of a front end loader includes a platform which alternately functions as a rigid extension of the bottom or top of the bucket. The platform is pivotally carried between the outer ends of a pair of parallel arms which are pivoted at their other ends to the opposite sides of the bucket. The platform seats firmly on the blade which extends from the bottom of the bucket and may be moved upwardly to a position wherein it may be secured on top of the bucket. A pair of stop plates control the pivoting of the platform as the arms are raised or lowered.

10 Claims, 4 Drawing Figures

BUCKET ATTACHMENT

BACKGROUND AND SUMMARY OF THE INVENTION

This invention relates to an attachment which forms an extension of the bucket of a conventional front end loader.

A front end loader carrying a bucket thereon is a convenient implement that finds particular utility on farms among its many uses. The front end loader has become a popular farm vehicle because of the suitability of the bucket as a container for readily loading and transporting quantities of dirt, rock, fodder, and like material, as well as larger objects, including young animals and various types of tools.

One problem that has detracted from the versatility of the front end loader is the limited size of the bucket. Since the bucket is necessarily a heavy, sturdy structure, its size and loading capacity is restricted by practical considerations. Consequently, the transfer of a substantial amount of material such as dirt or rock requires several trips and repeated loading and unloading of the bucket. Furthermore, when the bucket is loaded to capacity, material tends to spill from the bucket and often falls or is blown into the radiator or engine of the loader. Fence posts and other relatively long articles will not fit into the bucket, so these large objects must presently be transported by other means.

The present invention enhances the versatility of a front end loader by providing an attachment that increases the capacity of the bucket without a substantial weight increase. A platform carried between a pair of pivot arms is movable between a down position and an up position to alternately form a rigid extension of the bucket bottom or the bucket top. In the down position, the platform enlarges the bottom of the bucket to provide additional loading capacity and a sturdy support for carrying large and heavy objects. Also, since the platform extends forwardly beyond the sides of the bucket, relatively long articles that would not ordinarily fit in the bucket may be carried on the platform. Such a configuration enables the attachment to be used as a scaffold. Workmen may stand on the platform and the bucket may be raised to permit the workmen to paint, load, or otherwise work at an elevated position without the dangers associated with the use of a ladder.

In the up position, the platform extends forwardly from the top of the bucket to provide a considerably increased capacity for carrying large quantities of material. Since the platform presents a large surface on the rearward side of the raised bucket, material such as dirt, silage and rocks cannot easily spill from the back of the bucket to clog the radiator or engine of the loader.

It is an object of this invention to provide a unique attachment for a bucket that increases the bucket capacity and versatility of a front end loader or similar vehicle.

Another object of the invention is to provide a uniquely constructed attachment of the character described that is selectively movable to function alternately as an extension of the bucket bottom or as an extension of the bucket top. In conjunction with this object, it is a feature of the invention that the attachment is firmly securable in either of its two operating positions and may be quickly and easily moved therebetween.

Another object of the invention is to provide an attachment of the character described that may be easily installed on the bucket or removed therefrom.

A further object of the invention is to provide an attachment of the character described that is constructed of a minimum number of parts and is relatively light in weight.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith, and in which like numbers are employed to indicate like parts in the various views.

Figure 1:
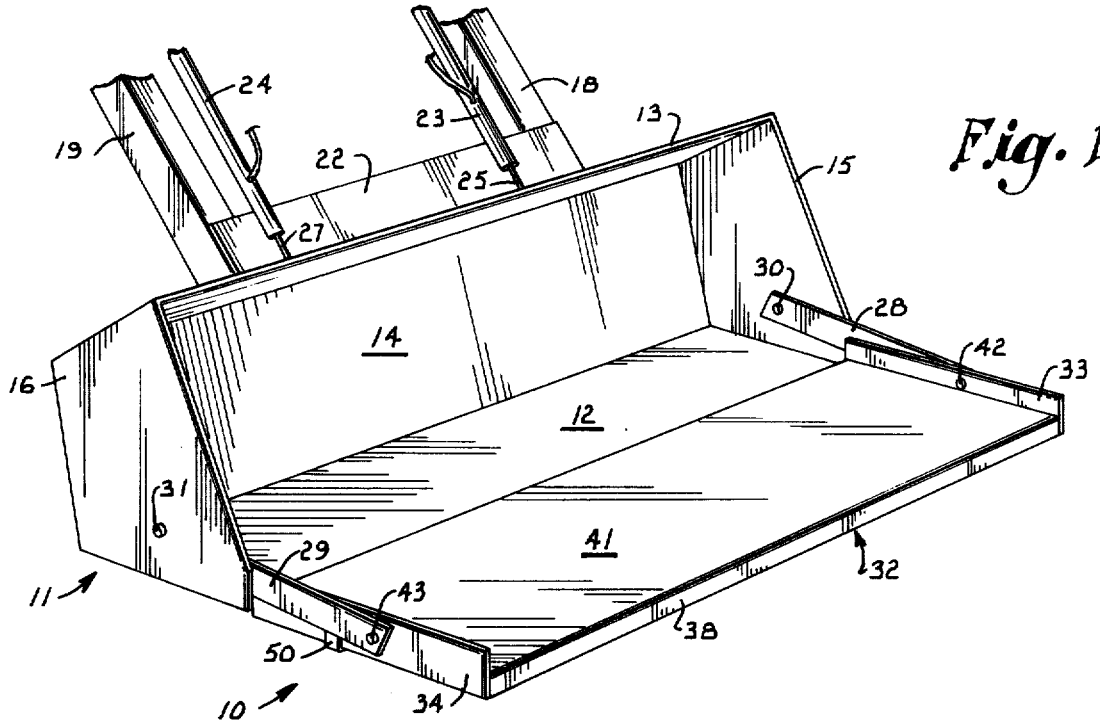
FIG. 1 is a perspective view illustrating an attachment embodying the subject invention installed on the bucket of a conventional front end loader and located in a first operating position.

Referring now to the drawing in detail, a bucket attachment constructed in accordance with the present invention is generally designated by reference numeral 10. Attachment 10 is adapted for installation on the bucket 11 of a conventional front end loader (not shown). The bucket 11 illustrated in the drawing is of a typical configuration, having a bottom panel 12, a top panel 13, a back panel 14, and a pair of opposite side plates 15 and 16. A short blade 17 (FIGS. 2 and 3) is integral with bottom panel 12 and extends slightly forwardly therefrom.

The front end loader includes a pair of parallel arms 18 and 19 on which bucket 11 is pivotally carried in the usual manner. A bracket 20 is secured near the bottom of back panel 14. The outer end of arm 18 is pivoted to bracket 20 by a pivot connection 21, while the outer end of arm 19 is similarly pivoted to bracket 20 by a second pivot connection (not shown) on the opposite side of the bracket. Arms 18 and 19 are interconnected by a cross member 22 and may be raised and lowered to manipulate bucket 11 accordingly.

To effect pivotal movement of bucket 11 about the ends of arms 18 and 19, a pair of hydraulic cylinders 23 and 24 are mounted above the respective arms. The piston rod 25 of cylinder 23 is pivoted to bracket 20 by a pivot connection 26, and the opposite end of cylinder 23 is pivotally connected to the top end of arm 18. In a similar manner, cylinder 24 has its piston rod 27 pivoted to bracket 20 and its opposite end pivoted to the top end of arm 19. The cooperative extension and retraction of piston rods 25 and 27 operates to pivot bucket 11 about a horizontal axis in the desired manner.

Attachment 10 includes a pair of pivot arms 28 and 29, which are adapted to be pivotally connected to the opposite bucket sides in parallel relation. A pivot coupling 30 is utilized to secure one end of arm 28 to the inner surface of side plate 15 at an intermediate location slightly above bottom panel 12. One end of arm 29 is similarly connected to the inward surface of the opposite side plate 16 at a corresponding location thereon by pivot coupling 31.

Figure 2:
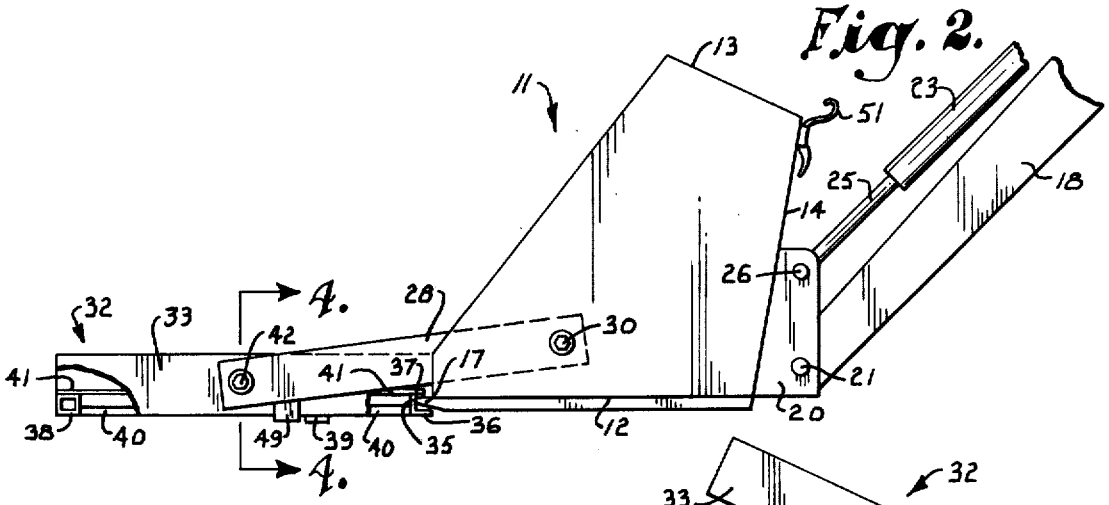
FIG. 2 is a side elevational view from the right side of FIG. 1, with certain portions broken away to more clearly illustrate the structure of the platform.
Figure 3:
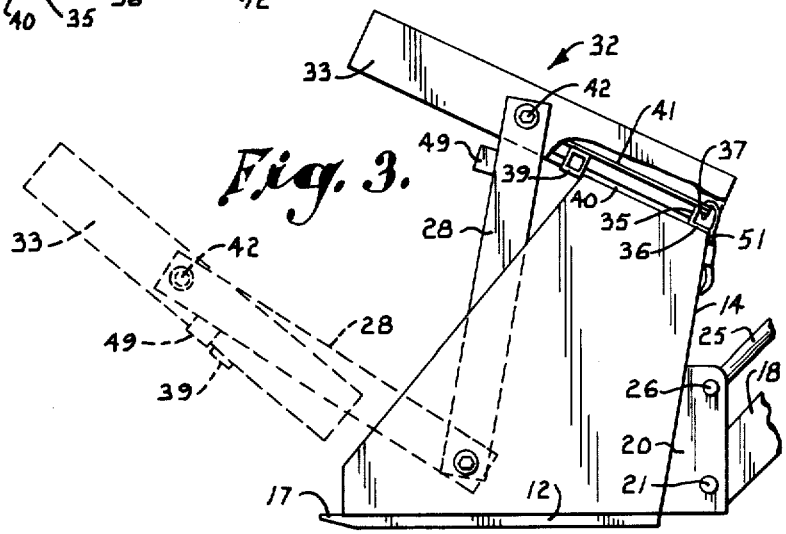
FIG. 3 is a side elevational view, partially broken away, similar to FIG. 2, but with the attachment moved to a second operating position and with the broken line view showing an intermediate position of the attachment.

A rigid platform, designated generally by numeral 32, is pivotally carried between the outer ends of arms 28 and 29. Platform 32 is secured (as by welding) between a pair of opposite side walls 33 and 34 which are of a height greater than the thickness of the platform. Referring to FIGS. 2 and 3, it may be seen that the inner edge of platform 32 comprises a substantially C-shaped channel section 35 which extends perpendicularly between side walls 33 and 34. Channel 35 has a lower leg 36 which is somewhat longer than its upper leg 37 so that the channel will readily fit over blade 17 of the bucket when the attachment is in its down position (FIG. 2).

A square tubular structural 38 forms the opposite or outward edge of platform 32, while at least one intermediate member 39 (FIG. 3) is spaced in parallel relation between channel 35 and structural 38 and secured at its opposite ends to side walls 33 and 34. The bottom of member 39 is located slightly below the bottom edges of side walls 33 and 34. Also, one or more structural members such as member 40 interconnect channel 35, structural 38 and intermediate member 39 at a right angle to provide further overall strength. A rigid floor plate 41 overlies channel 35, tube 38 and the various other structural members and is secured thereto and to the opposite side walls 33 and 34.

Side walls 33 and 34 of platform 32 are pivoted to the outer ends of the respective arms 28 and 29 to locate the platform therebetween. A pivot coupling 42 connects arm 28 to wall 33 approximately midway of the height of the wall and above floor plate 41. Another pivot coupling 43 is used to pivot arm 29 to side wall 34 at a corresponding position. Pivot couplings 42 and 43 are preferably located slightly forwardly of the transverse center of walls 33 and 34 so that the majority of the weight of platform 32 is disposed rearwardly of the pivot couplings.

Figure 4:
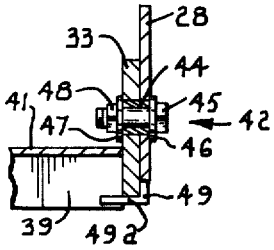
FIG. 4 is a fragmentary sectional view taken generally along line 4—4 of FIG. 2 in the direction of the arrows.

Pivot coupling 42, shown in detail in FIG. 4, is illustrative of the preferred structure of the other pivot couplings 30, 31, and 43. Pivot coupling 42 includes a cylindrical bushing 44 which is fitted through apertures formed in arm 28 and the platform side wall 33. A bolt 45 extends through the bore of bushing 44 and is provided with enlarged washers 46 and 47 which are retained at the opposite ends of the bushing by a nut 48 threaded onto bolt 45.

To prevent undesirable pivoting of platform 32 about arms 28 and 29 as the platform is moved between its operating positions, a pair of angled stop plates 49 and 50 are provided. The top edge of each stop plate 49 and 50 is angled slightly, with these angled edges being secured to the bottom edges of the respective arms 28 and 29 at positions rearwardly of the pivot connections 42 and 43. Each plate 49 and 50 includes an inwardly extending bottom leg. The bottom legs of plates 49 are numbered as 49*a* in FIG. 4 and 50a (not shown). Leg 49*a* extends inwardly beneath side wall 33 when platform 32 is positioned in extension from the bottom of bucket 11, while the similar bottom leg (50*a*) of angled plate 50 extends inwardly beneath the opposite side wall 34 in a like manner.

A pair of hook-like fasteners 51 are secured in spaced relation to the back of bucket 11 near the top thereof for the purposes of releasably locking platform 32 to the bucket top (see FIG. 3). The top leg 37 of channel 35 is provided with a pair of suitably spaced apertures which are located such that one of the hooks 51 can be inserted in each aperture. Hooks 51 are preferably stretchably mounted so that when engaged in the channel apertures, they will be placed under tension. This construction assures a firm locking of plat-orm 32 on the bucket top, while permitting the hooks to be quickly and easily removed from the apertures when it is desired to move the platform. It is noted that when platform 32 is positioned on top of bucket 11, the intermediate member 39 on the bottom side of the platform engages top panel 13 along the front edge thereof to prevent any material from passing over the top of the bucket.

The installation of attachment 10 on bucket 11 is easily accomplished by mounting the two hooks 51 on the back of the bucket and securing pivot couplings 30 and 31 in position to pivotally attach arms 28 and 29 to the respective opposite sides 15 and 16 of the bucket. When the installed attachment 10 is in the down position shown in FIG. 2, blade 17 is received within channel 35 between the legs thereof to secure platform 32 in rigid outward extension from the bucket bottom 12. Any tendency of platform 32 to rotate in either direction as loads are received thereon causes one of the channel legs 36 or 37 to engage blade 17 and thereby preclude any yielding or rotation of the platform.

To raise attachment 10 from the FIG. 2 position to the position shown in solid lines in FIG. 3, arms 28 and 29 are swung upwardly and at the same time platform 32 is tilted slightly to permit the separation of channel 35 from blade 17. It is noted that the provision of a channel having a short upper leg 37 facilitates the separation since a longer upper leg would engage the top of blade 17 considerably rearwardly of the front edge thereof to interfere with the removal of bottom leg 36 from below the blade. It is further significant to note that as arms 28 and 29 are swung upwardly, platform 32 is precluded from rotating relative to the arms in a clockwise direction (as viewed in FIGS. 2 and 3) due to engagement of the angled stop plates 49 and 50 with the bottoms of the respective side walls 33 and 34. When the upwardly swinging arms have reached the approximate position shown in broken lines in FIG. 3, platform 32 is pivoted in a counterclockwise direction to permit its correct positioning on top of the bucket. Hooks 51 are then engaged in the apertures in channel 35 to secure the platform in rigid outward extension from top panel 13, with the intermediate member 39 tightly engaging the front edge of the bucket top, as previously related.

To again lower platform 32 to the FIG. 2 position, hooks 51 are removed from the channel apertures and arms 28 and 29 are lowered. Due to the previously described weight distribution of platform 32, with the majority of the weight located rearwardly of its pivot connection to arms 28 and 29, platform 32 tends to rotate slowly about the arms in a clockwise direction as viewed in FIG. 3. After the platform engages angled plates 49 and 50, further relative clockwise rotation is precluded and channel 35 is eventually positioned on blade 17. Aside from its previously related advantage in facilitating the removal of platform 32 from blade 17, the use of a channel 35 having a short upper leg 37 also greatly simplifies the positioning of the channel over blade 17. For example, if upper leg 37 was considerably longer relative to lower leg 36, it would engage the top of blade 17 before the lower leg could be properly positioned beneath the blade.

It should be apparent that angled plates 49 and 50 effectively control the rotation of platform 32 to assure that the platform is retained in the proper position during both the raising and lowering operations. In the absence of plates 49 and 50, the platform tends to rotate uncontrollably to thereby present a substantial positioning problem, particularly in view of the accuracy required to correctly locate channel 35 over blade 17. The angled orientation of plates 49 and 50 is also significant because a slightly angled approach of channel 35 toward blade 17 is assured, and quick and accurate positioning between the channel and blade is thus further facilitated. Of course, attachment 10 is adapted for use with buckets constructed differently from that illustrated herein, and certain of the components can be suitably modified for installation on buckets of various configurations.

From the foregoing, it will be seen that this invention is one well adapted to attain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. An attachment for a vehicle carrying a bucket thereon, said bucket having a top, a bottom, and a pair of opposite sides, said attachment comprising:

arm means adapted for pivotal connection to said bucket;

a platform pivotally coupled to said arm means, said platform and arm means being pivotally movable between a first position wherein said platform forms an extension of said bucket bottom and a second position wherein said platform forms an extension of said bucket top; and means for locking said platform to said bucket in rigid extension from said bucket top.

2. An attachment as in claim 1, including means for selectively controlling the pivotal movement of said platform with respect to said arm means as the latter pivots with respect to said bucket.

3. An attachment as in claim 1, wherein said platform includes a transverse channel positioned to receive an edge of said bucket bottom to secure said platform in rigid extension from said bucket bottom.

4. An attachment as in claim 3, wherein said channel includes spaced upper and lower legs, said upper leg being shorter than said lower leg.

5. An attachment for a vehicle carrying a bucket thereon, said bucket having a top, a bottom, and a pair of opposite sides, said attachment comprising:

a pair of parallel arms adapted for pivotal connection at one end to the respective opposite sides of said bucket;

a platform pivotally coupled to said arms at the other ends thereof, said platform and arms being pivotally movable between a first position wherein said platform forms an extension of said bucket bottom and a second position wherein said platform forms an extension of said bucket top; and a stop member engageable with said platform and one of said arms at a position offset from the pivot connection therebetween to limit pivotal movement of said platform with respect to said arms in one pivotal direction, while permitting free pivotal movement of said platform with respect to said arms in the opposite pivotal direction.

6. An attachment as in claim 5, wherein said stop member is oriented to retain said platform at an angle with respect to said arms.

7. An implement for a vehicle, said implement comprising:

a bucket adapted to be mounted on the vehicle, said bucket having a top, a bottom, and a pair of opposite sides;

arm means pivotally connected to said bucket; and a platform pivotally coupled to said arm means, said platform and arm means being pivotally movable between a first position wherein said platform forms an extension of said bucket bottom and a second position wherein said platform forms an extension of said bucket top.

8. An implement as in claim 7, including means for selectively controlling the pivotal movement of said platform with respect to said arm means as the latter pivots with respect to said bucket.

9. An implement as in claim 7, including means for locking said platform to said bucket in rigid extension from said bucket top.

10. An implement as in claim 7, including a stop member engageable with said platform and arm means at a position offset from the pivot connection therebetween to limit pivotal movement of said platform with respect to said arm means in one pivotal direction, while permitting free pivotal movement of said platform with respect to said arm means in the opposite pivotal direction.

* * * * *